United States Patent [19]

Brinton

[11] 4,003,331

[45] Jan. 18, 1977

[54] EXHAUST VALVE ASSEMBLY FOR PREVENTING INGRESS OF WATER TO AN OUTBOARD MARINE ENGINE

[75] Inventor: Michael Brian Jervis Brinton, East Cowes, England

[73] Assignee: R. N. L. I. (Trading) Limited, England

[22] Filed: July 30, 1975

[21] Appl. No.: 600,304

[30] Foreign Application Priority Data

Aug. 1, 1974 United Kingdom ..... 34031/74

[52] U.S. Cl. ..... 115/17; 115/.5 E

[51] Int. Cl.[2] ..... B63H 21/32; B63H 21/26

[58] Field of Search ..... 115/.5 E, 6.1, 17, 70; 114/16.4, 50–54; 9/9; 128/145 A

[56] References Cited

UNITED STATES PATENTS

| | | | |
|---|---|---|---|
| 2,317,237 | 4/1943 | Wilen | 128/145 A |
| 3,051,170 | 8/1962 | Benzel | 128/145 A |
| 3,062,172 | 11/1962 | Moore | 115/6.1 |
| 3,745,962 | 7/1973 | Murphy | 115/70 |

*Primary Examiner*—Trygve M. Blix
*Assistant Examiner*—Stuart M. Goldstein
*Attorney, Agent, or Firm*—Rose & Edell

[57] ABSTRACT

A marine outboard motor is provided with an exhaust valve assembly to operate automatically and prevent ingress of water in the event of a capsize. The exhaust gases pass downward through a vertical tube, to a ring of exhaust ports in the tube wall and, if the engine is inverted, a weighted sleeve fitted telescopically round the lower end of the tube drops into a position where it closes the exhaust ports in a fluid-tight manner. Inside the tube is a check-valve in the form of a captive ball, that upon inversion, drops on to a valve seat located above the ring of exhaust ports.

6 Claims, 2 Drawing Figures

EXHAUST VALVE ASSEMBLY FOR PREVENTING INGRESS OF WATER TO AN OUTBOARD MARINE ENGINE

This invention relates to engine exhaust valve assemblies. More particularly, this invention relates to a method and device for rendering watertight the motor power head of certain marine outboard motors in the event of capsize of the powered craft.

It is well-known and hitherto unremedied defect of outboard motors that, on capsize of the powered craft, water will ingress, via the exhaust housing, into the power head. This necessitates delay, on righting the craft, whilst clearing the cylinders and crankcase of salt water by removing the sparking plugs and spinning the flywheel either with the starter motor or by manual means. Furthermore, it is manifestly disadvantageous to the efficient working of the combustion system to allow ingress of water of any sort, particularly salt water with its high corrosive capability.

This invention seeks to provide a simple remedy for the above mentioned defect which, in one embodiment hereinafter described, is particularly simply fitted to 50 h.p. outboard motors, especially the "Evinrude" or "Johnson" outboard motors.

According to the present invention, there is provided a method of preventing ingress of water, in the event of a capsize, to the exhaust housing of a marine engine especially an outboard motor, which method comprises leading the exhaust gases of the engine through a vertical or inclined tube in which exhaust ports are provided, and fitting the tube with gravity-actuated weighted means effective to provide a fluid-tight closure of the exhaust ports on inversion of the engine.

This invention also provides a device for use in accordance with the invention and comprising a vertical or inclined tube through which the exhaust gases of the engine pass said tube being provided with exhaust ports, and gravity-actuated weighted means fitted to the tube such as to effect fluid-tight closure of the exhaust ports upon inversion of the engine.

Preferably, the gravity-actuated means comprises a weighted sleeve that is coaxial with and slides telescopically about the tube.

Figure 1:
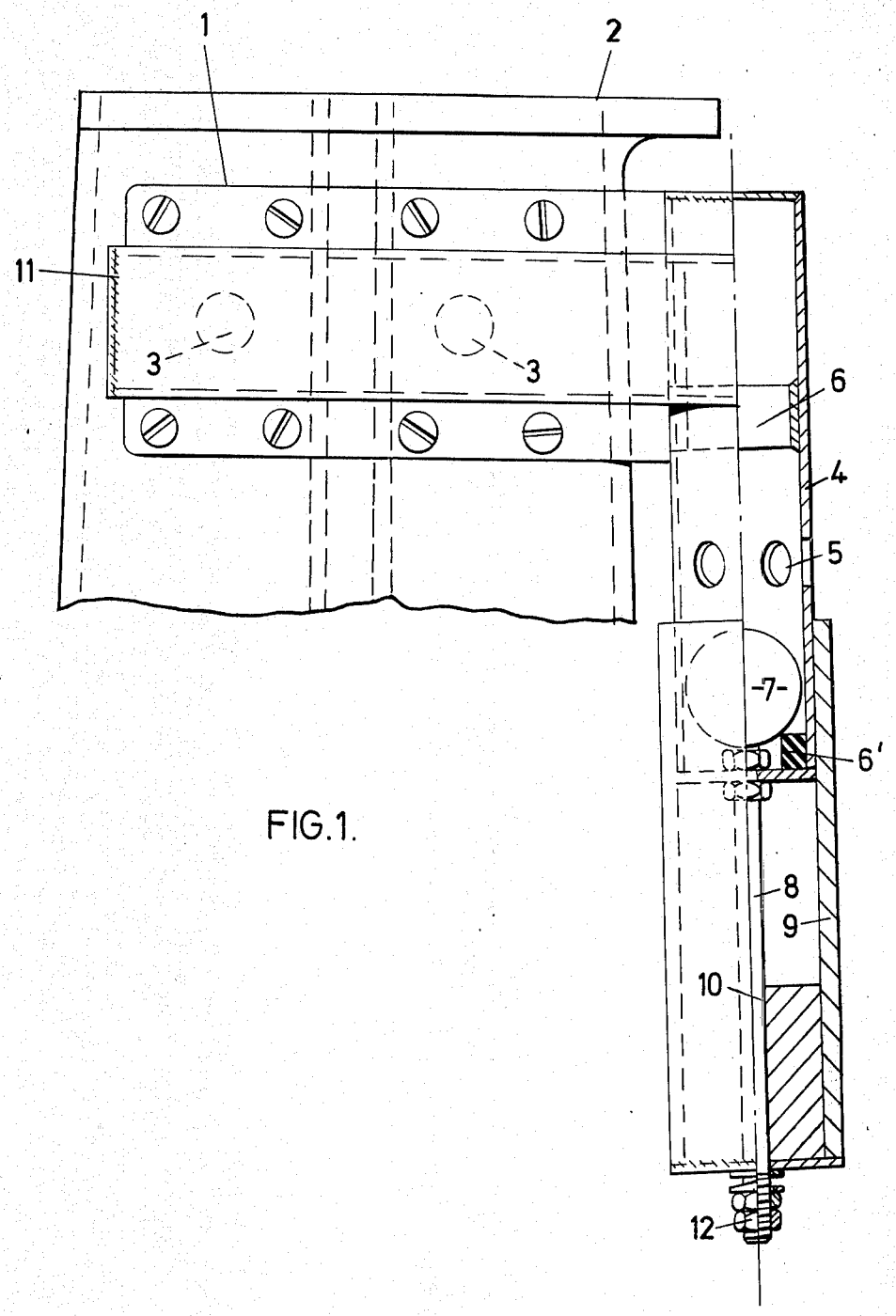
Figure 2:
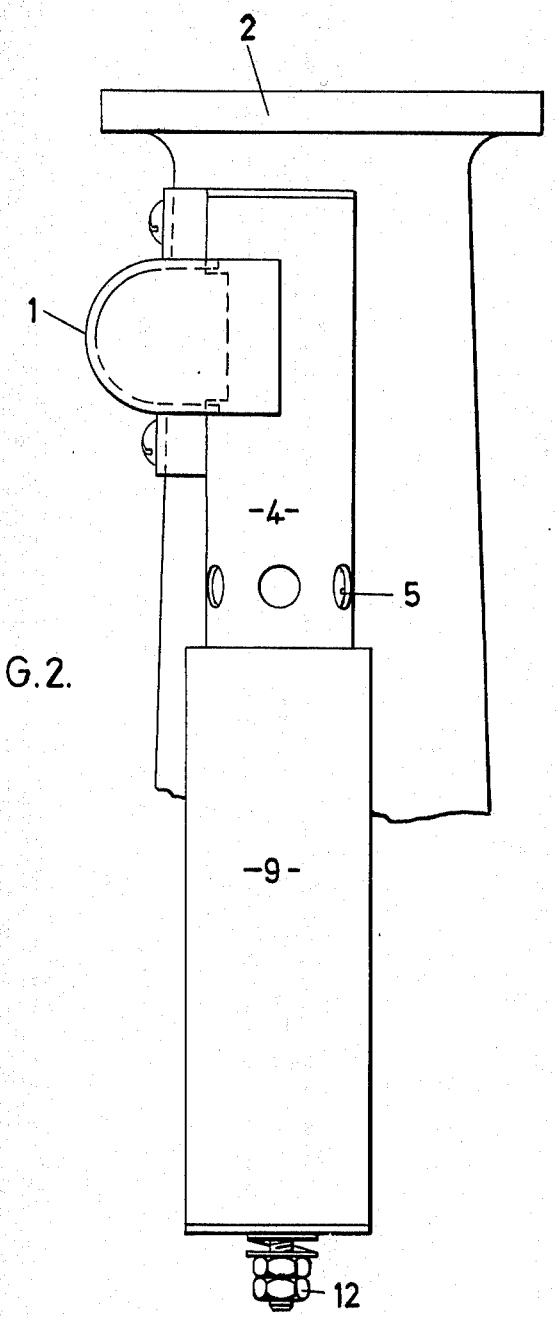

One embodiment of the invention will now be described, by way of example, with reference to the accompanying drawings in which:

FIG. 1 is a side view of a device according to the invention mounted on the exhaust housing of an outboard motor, and FIG. 2 is a rear view of that device.

Referring to the drawings, a horizontal stainless steel manifold, closed at one end 11, is secured, in fluid-tight manner to an exhaust housing 2 of a marine outboard motor and of which the existing exhaust relief orifices 3 open into the manifold. Depending from and sealing the open end of the manifold 1 is a vertical tube 4 which has its lower end portion remote from the manifold 1 fitted telescopically into a sleeve 9. The tube 4 has five equiangularly circumferentially disposed exhaust outlet ports 5 interposed between two seats 6, 6′ provided within the tube for a captive ball 7. The lower ball seat 6′ is in the form of a rubber cushion and the upper seat 6 is of stainless steel and the ball is free to move between the two seats. A vertical rod 8 is rigidly attached at its upper end to the bottom end of the tube 4 and extends downward within the sleeve 9, to pass through a closure plate at the bottom end of the sleeve. Below the sleeve end the rod 8 carries nuts 12 forming a stop for the sleeve 9. The sleeve 9 contains ballast 10 and is of sufficient length to provide a fluid-tight cover for the ports 5 when the tube 4 and sleeve 9 are telescopically contracted.

On capsize of the marine craft, (not shown) to which the outboard motor is fitted, the ball 7 travels in the tube 4 to the stainless steel seat 6 just after the angle of heel exceeds 90°; the sleeve 9 with ballast 10 follows, thus providing a fluid-tight cover for the ports 5 so that the exhaust housing is doubly sealed against the ingress of water. On righting of the craft, the ball 7 travels back to the rubber cushion seat 6¹ and the sleeve 9 with ballast 10 will slide back to its stop 12 on the rod 8, thereby re-exposing the ports 5.

What I claim is:

1. An automatic valve assembly for preventing ingress of water to a gas-flow housing of an outboard marine engine in the event of a capsize, comprising a gas manifold for attachment to said housing and having a gas-flow opening, a gas-flow tube secured to said manifold at the location of said gas-flow opening and having its interior communicating with said gas-flow opening, said gas-flow tube being oriented approximately vertically and having at least one gas-flow port in its tube wall at a location spaced vertically from its communication with said gas-flow opening of said manifold, a movable valve member mounted on said tube and normally resting in a position where said port is unobstructed by it, which valve member is slidable relatively to said tube to a closed position where it obstructs said port if the valve assembly is inverted, and gravity-actuated valve-operating means mounted on said tube to operate said valve member and slide it into the closed position upon inversion of the assembly.

2. A device according to claim 1, wherein the gravity-actuated means comprises a weighted sleeve that is coaxial with and slides telescopically about the tube.

3. A device according to claim 2, wherein, the tube and sleeve are vertical with the sleeve extending below the tube, and a rod fixed to and depending from the tube passes down through the sleeve and has at its lower end a stop to limit downward movement of the sleeve.

4. A device according to claim 1, the valve member comprising a gravity-actuated ball check valve contained within said tube.

5. A device according to claim 4, wherein the check valve comprises a captive ball, and lower and upper ball seats which are respectively below and above said gas-flow port and between which the ball is free to move under its own weight ports.

6. A device according to claim 5, wherein the ball seat above said port is a precision valve seat of stainless steel.

* * * * *